US008059979B2

(12) United States Patent
Deguchi et al.

(10) Patent No.: US 8,059,979 B2
(45) Date of Patent: Nov. 15, 2011

(54) CONTROL OF A POWER SUPPLY FOR A TRANSFER UNIT IN AN IMAGE FORMING APPARATUS

(75) Inventors: Hideaki Deguchi, Nagoya (JP); Yusuke Yanagihara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 211 days.

(21) Appl. No.: 12/332,609

(22) Filed: Dec. 11, 2008

(65) Prior Publication Data

US 2009/0169230 A1 Jul. 2, 2009

(30) Foreign Application Priority Data

Dec. 27, 2007 (JP) ..... 2007-337376

(51) Int. Cl.
*G03G 15/16* (2006.01)

(52) U.S. Cl. ..... 399/66

(58) Field of Classification Search ..... 399/66, 399/89, 314
See application file for complete search history.

(56) References Cited

U.S. PATENT DOCUMENTS

| | | | | |
|---|---|---|---|---|
| 5,999,760 | A | 12/1999 | Suzuki et al. | |
| 6,404,998 | B1 | 6/2002 | Tanaka et al. | |
| 7,266,318 | B2 * | 9/2007 | Inukai | 399/66 |
| 7,376,366 | B2 | 5/2008 | Deguchi | |
| 7,558,501 | B2 * | 7/2009 | Saito et al. | 399/88 |
| 2005/0100357 | A1 | 5/2005 | Nishimura et al. | |
| 2006/0029410 | A1 | 2/2006 | Deguchi | |

FOREIGN PATENT DOCUMENTS

| | | | |
|---|---|---|---|
| EP | 0520819 | | 12/1992 |
| JP | 06308844 | A * | 11/1994 |
| JP | 2000089586 | A * | 3/2000 |
| JP | 2004-334017 | | 11/2004 |
| JP | 2005-189466 | | 7/2005 |
| JP | 2006-053175 | | 2/2006 |

OTHER PUBLICATIONS

European Search Report corresponding to Patent Application No. 08021237.6 mailed Jun. 4, 2009.

* cited by examiner

*Primary Examiner* — Robert Beatty
(74) *Attorney, Agent, or Firm* — Banner & Witcoff, Ltd

(57) ABSTRACT

An image forming apparatus has a transfer unit, a power supply unit that takes a value of a current imparted to the transfer unit as a control target and that supplies power conforming to the value of the control target to the transfer unit; and a determination unit that acquires a detection value of a voltage detection unit and a detection value of a current detection unit and that determines, as a control target value for the power supply unit, an optimum value for the control target derived from a characteristic line showing a relationship between both detection values or a detection value of the voltage detection unit and an optimum value of the control target. The characteristic line is a line showing a relationship of a change in the absolute value of the optimum value for the control target shifting from an increasing tendency to a decreasing tendency with an increase in both detection values or the detection value of the voltage detection unit.

6 Claims, 10 Drawing Sheets

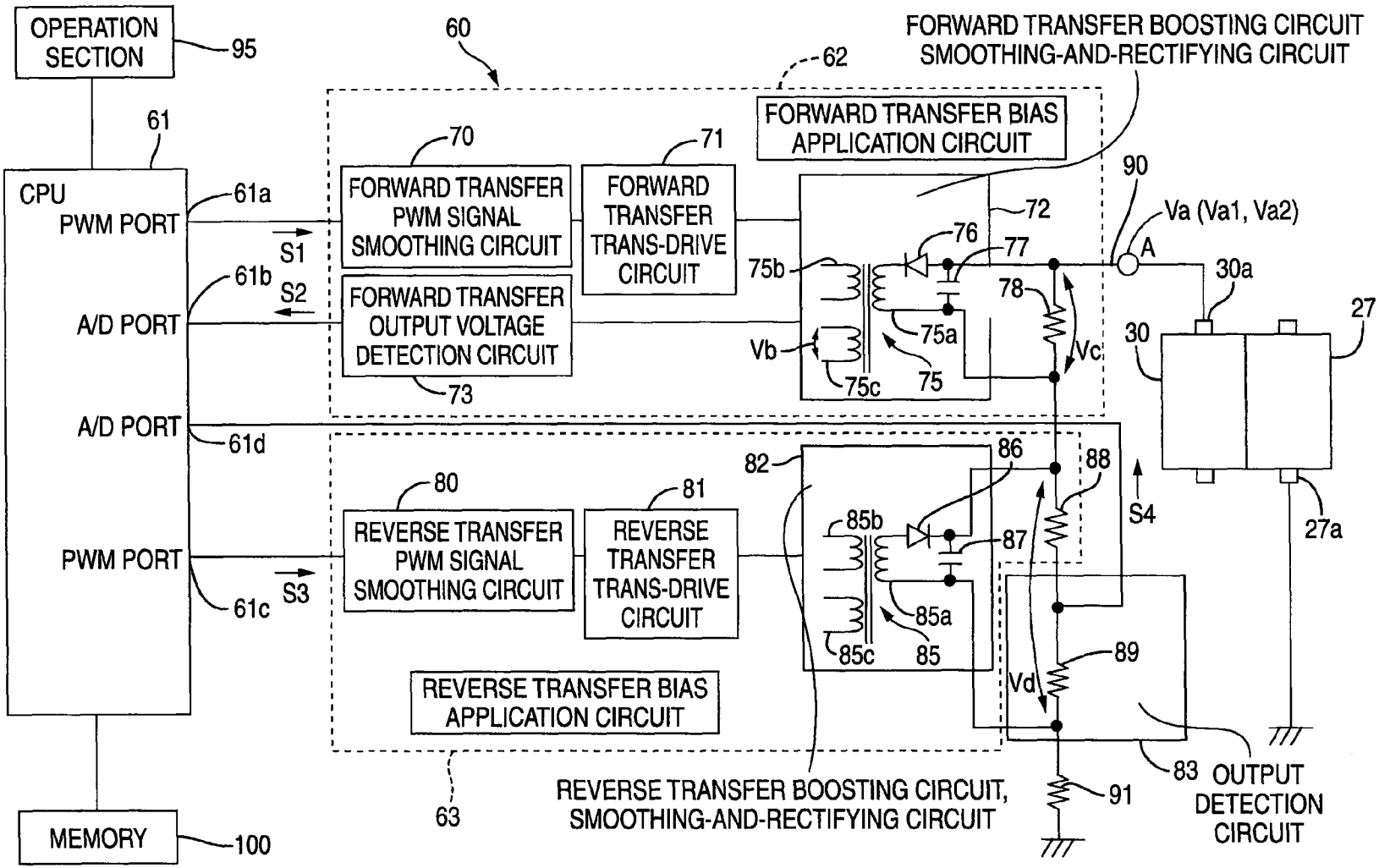
FIG. 2
FORWARD TRANSFER BOOSTING CIRCUIT SMOOTHING-AND-RECTIFYING CIRCUIT
FORWARD TRANSFER BIAS APPLICATION CIRCUIT
FORWARD TRANSFER TRANS-DRIVE CIRCUIT
FORWARD TRANSFER PWM SIGNAL SMOOTHING CIRCUIT
FORWARD TRANSFER OUTPUT VOLTAGE DETECTION CIRCUIT
REVERSE TRANSFER TRANS-DRIVE CIRCUIT
REVERSE TRANSFER PWM SIGNAL SMOOTHING CIRCUIT
REVERSE TRANSFER BIAS APPLICATION CIRCUIT
REVERSE TRANSFER BOOSTING CIRCUIT, SMOOTHING-AND-RECTIFYING CIRCUIT
OUTPUT DETECTION CIRCUIT
OPERATION SECTION
CPU
PWM PORT
A/D PORT
A/D PORT
PWM PORT
MEMORY
Va (Va1, Va2)
Vb
Vc
Vd
S1
S2
S3
S4
A
60
61
61a
61b
61c
61d
62
63
70
71
72
73
75
75a
75b
75c
76
77
78
80
81
82
83
85
85a
85b
85c
86
87
88
89
90
91
95
100
27
27a
30
30a

CONTROL OF A POWER SUPPLY FOR A TRANSFER UNIT IN AN IMAGE FORMING APPARATUS

CROSS REFERENCE TO RELATED APPLICATION

The present application claims priority from Japanese Patent Application No. 2007-337376, which was filed on Dec. 27, 2007, the disclosure of which is herein incorporated by reference in its entirety.

TECHNICAL FIELD

Apparatuses and devices consistent with the present invention relate to an image forming apparatus and, more specifically, to control of power supply to a transfer unit provided in the image forming apparatus.

BACKGROUND

In an image forming apparatus of this type, great fluctuations arise in electrical resistance values of a transfer unit, an image carrier, and a recording sheet to be nipped between the transfer unit and the image carrier depending on an ambient environment (particularly a temperature and a humidity). Accordingly, appropriate power supply must be provided according to changes in the ambient environment. For instance, when power supply becomes deficient, the force of adhesion of toner on the recording medium becomes insufficient, whereby the toner is left on the image carrier after transfer and the toner left after transfer is transferred to another position on the recording medium. Conversely, power supply becomes excessive, whereupon toner may splash or the image carrier may be damaged by electric discharge.

Japanese unexamined patent application publication No. JP-A-2006-53175 describes a related art image forming apparatus. The related image forming apparatus controls a transfer current to be applied to a transfer roller so as to come to an optimum value conforming to respective ambient environments. Specifically, a load resistance value of a transfer unit system including a transfer roller is measured, and an optimum value of a transfer current corresponding to the load resistance value is determined in accordance with a predetermined characteristic curve. The transfer current is controlled so as to come to this optimum value. The characteristic curve is a curve showing the correlation between respective load resistance values of the transfer unit system that change according to the ambient environment and optimum values of the transfer current corresponding to the respective load resistance values.

SUMMARY

Incidentally, in relation to the related-art image forming apparatus, the characteristic curve is one that was experimentally determined beforehand at the lowest humidity (e.g., 20%) of recommended use conditions submitted by a manufacturer. Therefore, there is a risk of toner splashing at high humidity by reason of an excessive power supply, to thus deteriorate image quality.

The present invention has been conceived in the light of the circumstance and aims at providing an image forming apparatus capable of inhibiting a decrease in image quality, which would otherwise be caused by a change in humidity.

An image forming apparatus of the first invention serving as a means for achieving the object is an image forming apparatus comprising: a transfer unit for transferring a toner image carried on an image carrier to a recording medium; a power supply unit that, while taking a current value imparted to the transfer unit as a control target, supplies power conforming to the control target value to the transfer unit; a voltage detection unit for detecting a voltage value for the transfer unit; a current detection unit for detecting a value of a current flowing to the transfer unit; and a determination unit that acquires a detection value of the voltage detection unit and a detection value of the current detection unit and that determines, as a control target value for the power supply unit, an optimum value of a control target derived from a characteristic line showing a relationship between an electric characteristic value based on both detection values or a detection value of the voltage detection unit and an optimum value of the control target, wherein the characteristic line is a line showing a relationship of a change in absolute value of an optimum value of the control target shifting from an increasing tendency to a decreasing tendency with an increase in an absolute value of the electrical characteristic value or an absolute value of the detection value of the voltage detection unit.

The inventors of the present invention found, by means of a test, the fact that the absolute value of an optimum value of a control target tends to decrease at low humidity with an increase in an absolute value of an electrical characteristic value based on a current value and a voltage value or an absolute value of a detection value of a voltage detection unit (hereinafter often called simply a "detection value") and that, on the contrary, the absolute value of the optimum value of the control target tends to increase with an increase in the detection value at high humidity.

Accordingly, the present invention is configured such that an optimum value of the control target is determined by utilization of a characteristic line showing a relationship of a change in the absolute value of the optimum value of the control target shifting from an increasing tendency to a decreasing tendency with an increase in the absolute value of a detection value. As a result, when compared with the related-art image forming apparatus utilizing a characteristic line of a monotonous increasing tendency, a decrease in image quality, which would otherwise be caused by a change in humidity, can be prevented.

BRIEF DESCRIPTION OF THE DRAWINGS

Illustrative aspects of the invention will be described in detail with reference to the following figures wherein:

FIG. 2 is a block diagram of the configuration of the principal section of a bias application circuit;

DETAILED DESCRIPTION OF EXEMPLARY EMBODIMENTS

An embodiment of the present invention will be described by reference to FIGS. 1 through 11.

1. Overall Configuration of an Image Forming Apparatus

Figure 1:
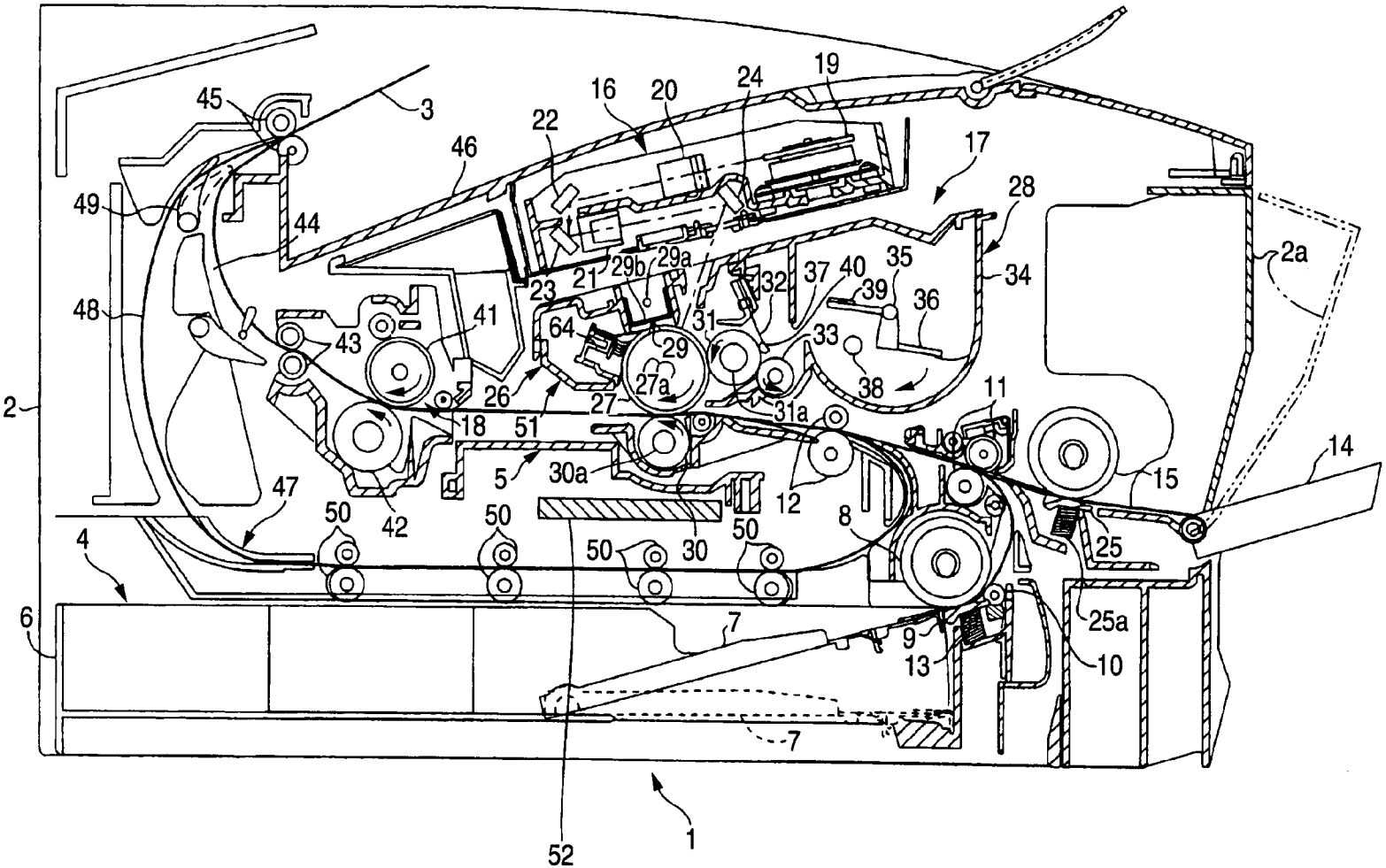
FIG. 1 is a side cross-sectional view showing the internal configuration of a laser printer of an embodiment of the present invention.

FIG. 1 is a side cross-sectional view of the principal section showing a laser printer 1 of the present embodiment (an example image forming apparatus). In FIG. 1, the laser printer 1 has, within a main-body frame 2, a feeder section 4 for feeding sheets 3 (an example recording medium), an image forming section 5 for generating an image on the thus-fed sheet 3, and the like. The following descriptions are provided on the assumption that the right side of the sheet of FIG. 1 is taken as a front side of the laser printer 1.

(1) Feeder Section

The feeder section 4 has, on an internal bottom of the main-body frame 2, a sheet feeding tray 6 to be removably attached, a sheet press plate 7 provided in the sheet feeding tray 6, a sheet feeding roller 8 and a separation pad 9 that are provided at elevated positions above a front end of the sheet feeding tray 6; paper powder removal rollers 10 and 11 disposed downstream from the sheet feeding roller 8 in the direction of conveyance of the sheet 3; and a registration roller 12 disposed downstream from the paper powder removal rollers 10 and 11 in the direction of conveyance of the sheet 3.

The sheet press plate 7 can stack the sheets 3 in a layered fashion. A distal end (a rear end) of the sheet press plate 7 from the sheet feeding roller 8 is supported in a swayable manner, whereby a proximal end (a front end) of the sheet press plate becomes vertically movable. Further, the sheet press plate is forced upwardly from the back by means of an unillustrated spring. Therefore, the sheet press plate 7 is downwardly swayed in defiance of restoration force of the spring with an increase in the amount of stacked sheet 3 while the rear end of the sheet press plate is taken as a fulcrum with respect to the sheet feeding roller 8. The sheet feeding roller 8 and the separation pad 9 are disposed opposite each other, and the separation pad 9 is pressed toward the sheet feeding roller 8 by means of a spring 13 provided on the back of the separation pad 9.

The topmost sheet 3 on the sheet press plate 7 is pressed toward the sheet feeding roller 8 from the back of the sheet press plate 7 by means of an unillustrated spring. After being nipped between the sheet feeding roller 8 and the separation pad 9 by means of rotation of the sheet feeding roller 8, the sheet is fed one at a time.

After paper dust has been removed from the thus-fed sheet 3 by means of the paper powder removal rollers 10 and 11, the sheet is delivered to the registration roller 12. The registration roller 12 is made up of a pair of rollers and arranged so as to send the sheet 3 to an image forming position after having subjected the sheet to registration. The image forming position is a transfer position where a toner image on a photosensitive drum 27 (an example image carrier) is to be transferred to the sheet 3. In the present embodiment, the image forming position is taken as a contact position where the photosensitive drum 27 contacts a transfer roller 30.

The feeder section 4 additionally has a multipurpose tray 14, and a multipurpose-tray-side sheet feeding roller 15 and a multipurpose-tray-side separation pad 25 for feeding the sheet 3 stacked on the multipurpose tray 14. The multipurpose-tray-side sheet feeding roller 15 and the multipurpose-tray-side separation pad 25 are disposed opposite each other. By means of a spring 25*a* provided on the back of the multipurpose-tray-side separation pad 25, the multipurpose-tray-side separation pad 25 is pressed toward the multipurpose-tray-side sheet feeding roller 15.

The sheet 3 stacked on the multipurpose tray 14 is fed one at a time after being nipped between the multipurpose-tray-side sheet feeding roller 15 and the multipurpose-tray-side separation pad 25 by means of rotation of the multipurpose-tray-side sheet feeding roller 15.

(2) Image Forming Section

The image forming section 5 has a scanner section 16, a process cartridge 17, and a fixing section 18.

(a) Scanner Section

The scanner section 16 is provided in an upper area within the main-body frame 2 and has a laser emission section (not shown), a polygon mirror 19 to be rotationally driven, lenses 20 and 21, and reflection mirrors 22, 23, and 24. As indicated by a chain line, a laser beam that is emitted from the laser emission section and that is based on image data sequentially passes through or undergoes reflection on the polygon mirror 19, the lens 20, the reflection mirrors 22 and 23, the lens 21, and the reflection mirror 24, to thus be radiated on the surface of the photosensitive drum 27 of the process cartridge 17 by means of a high-speed scan.

(b) Process Cartridge

The process cartridge 17 is disposed beneath the scanner section 16. The process cartridge 17 has a drum cartridge 26 removably attached to the main-body frame 2 and a developing cartridge 28 housed in the drum cartridge 26. As shown in FIG. 1, a front cover 2*a* that is reclosable while a lower end thereof is taken as a center axis is provided on the front surface of the main-body frame 2. The process cartridge 17 is removably housed in the main-body frame 2 by opening the front cover 2*a*.

The developing cartridge 28 is removably housed in the drum cartridge 26 and has a developing roller 31, a layer thickness regulation blade 32, a supply roller 33, and a toner hopper 34.

The toner hopper 34 is filled as a developing agent with nonmagnetic monocomponent toner having a positive electrification characteristic. Polymer toner is used as the toner. The polymer toner is produced by copolymerization of polymeric monomer; for instance, styrene-based monomer such as styrene, acrylic monomer such as an acrylic acid, alkyl (C1 to C4) acrylate, or alkyl (C1 to C4) meta-acrylate, through use of a known polymerization method such as suspension polymerization. The polymer toner assumes an essentially spherical shape and exhibits superior fluidity, so that formation of a high-quality image can be fulfilled.

Such toner is mixed with a coloring agent such as carbon black, wax, and the like. In order to enhance fluidity, an external additive, such as silica, is added to the toner.

Toner in a toner hopper 34 is stirred by an agitator 36 supported by a rotary shaft 35 provided in the center of the toner hopper 34 and emitted from a toner supply port 37 opened in a rear side of the toner hopper 34. The agitator 36 is rotationally driven in the direction of an arrow (a clockwise direction) by means of an input of power from an unillustrated motor. A window 38 for detecting a toner level is provided on either sidewall (either sidewall achieved along a depthwise direction of the sheet of FIG. 1) of the toner hopper 34, and the windows are cleaned by means of wipers 39 supported by the rotary shaft 35.

The supply roller 33 is rotatably provided at a position rear of the toner supply port 37. The developing roller 31 is rotatably disposed opposite the supply roller 33. The supply roller 33 and the developing roller 31 are brought into contact with each other in a state of being respectively compressed to a certain extent.

In the supply roller 33, a metal roller shaft is sheathed with a roller made of a conductive foaming material. The supply roller 33 is rotationally driven in a direction of an arrow (a counterclockwise direction) by means of an input of power from an unillustrated motor.

In the developing roller 31, a metal roller shaft 31*a* is sheathed with a roller formed from a conductive rubber material. More specifically, a roller of the developing roller 31 is formed by covering the surface of a roller main body formed from conductive urethane rubber or silicone rubber including carbon particles, or the like, with a coating layer of fluorine-containing urethane rubber or silicone rubber. The developing roller 31 is applied with a predetermined developing bias voltage during developing operation. The developing roller 31 is rotationally driven in the direction of an arrow (a counterclockwise direction) by means of an input of power from the unillustrated motor.

The layer thickness regulation blade 32 is disposed in the vicinity of the developing roller 31. Of the layer thickness regulation blade 32, an extremity of a blade main body formed from a metal leaf spring material is provided with a press section 40 that is made of insulating silicone rubber and that assumes a semispherical cross-sectional profile. The layer thickness regulation blade 32 is supported by the developing cartridge 28 in the proximity of the developing roller 31, and the press section 40 is brought into pressed contact with an upper portion of the developing roller 31 by means of elastic force of the blade main body.

The toner emitted from the toner supply port 37 is supplied to the developing roller 31 by means of rotation of the supply roller 33. At this time, the toner is positively electrified through friction between the supply roller 33 and the developing roller 31. Further, the toner supplied onto the developing roller 31 enters between the press section 40 of the layer thickness regulation blade 32 and the developing roller 31 along with rotation of the developing roller 31, to thus be carried over the developing roller 31 in the form of a thin layer of given thickness.

The drum cartridge 26 has the photosensitive drum 27, a scorotoron electrifier 29, a transfer roller 30 (an example transfer unit), and a cleaning brush 64 serving as a cleaning unit.

Of these elements, the photosensitive drum 27 is disposed opposite the developing roller 31 in the rear direction of the developing roller 31 and supported by the drum cartridge 26 so as to be rotatable in the direction of an arrow (a clockwise direction). The photosensitive drum 27 has a cylindrical drum main body and a metal drum shaft 27*a* that supports the drum main body and that is provided at a shaft center of the drum main body. The drum main body is built of an aluminum original pipe, and a polycarbonate photosensitive layer that exhibits a positive charging characteristic is formed on the surface of the original pipe. The drum shaft 27*a* is connected to a ground (see FIG. 2).

As shown in FIG. 1, the electrifier 29 is disposed opposite the photosensitive drum 27 at a position above the photosensitive drum while spaced a predetermined interval from the same so as not to contact the photosensitive drum, as well as being supported by the drum cartridge 26. The electrifier 29 is a scorotoron electrifier for positive charging that generates a corona discharge from an electrification wire 29*a* such as tungsten; has a grid 29*b* between the electrification wire 29*a* and the photosensitive drum 27; and uniformly electrifies the surface of the photosensitive drum 27 with positive polarity. A predetermined electrification bias voltage is applied to the electrification wire 29*a*.

After being uniformly, positively charged by the electrifier 29 along with rotation of the photosensitive drum 27, the surface of the photosensitive drum 27 is exposed to a laser beam from the scanner section 16 by means of a high-speed scan, whereupon an electrostatic latent image based on image data is generated.

Subsequently, the positively-charged toner carried over the surface of the developing roller 31 is brought into, in an opposing manner, contact with the photosensitive drum 27 by means of rotation of the developing roller 31. At this time, the toner is supplied to the electrostatic latent image generated on the surface of the photosensitive drum 27 and selectively carried, to thus be visualized. With this result, development is achieved.

The transfer roller 30 is disposed opposite the photosensitive drum 27 at a position below the photosensitive drum 27 and supported by the drum cartridge 26 so as to be rotatable in the direction of an arrow (a counterclockwise direction). In the transfer roller 30, a metal roller shaft 30*a* is sheathed with a roller made of a conductive rubber material.

The roller shaft 30*a* of the transfer roller 30 is connected to a bias application circuit 60 mounted on a high-voltage power circuit board 52. During transfer operation for transferring the toner image carried over the developing roller 31 to the sheet 3 at the transfer position (hereinafter called "forward transfer operation"), a forward transfer bias voltage Va1 (a bias voltage for transfer) is applied form the bias application circuit 60. In the embodiment, when the transfer roller 30 is cleaned before and after image forming operation or in the middle of operation for transferring an image to each sheet 3 during the image forming operation, a reverse transfer bias voltage Va2 (a bias voltage for reverse transfer), which is opposite in polarity to the forward transfer bias voltage Va1, is applied to the transfer roller 30 from the bias application circuit 60 (operation performed this time is called "reverse transfer operation"). Thereby, the toner adhering to the transfer roller 30 is electrically ejected over the photosensitive drum 27, and the toner is recovered by the developing roller 31 in conjunction with the toner still remaining on the surface of the photosensitive drum 27.

The cleaning brush 64 is disposed opposite so as to come into contact with the drum main body of the photosensitive drum 27. The cleaning brush 64 is made up of a conductive member; applied with a predetermined cleaning bias voltage; and plays the role of eliminating paper dust adhering to the photosensitive drum 27.

(c) Fixing Section

As shown in FIG. 1, the fixing section 18 is disposed in the rear of the process cartridge 17 and has a heating roller 41, a press roller 42 that presses the heating roller 41, and a pair of conveyance rollers 43 disposed downstream of the heating roller 41 and the press roller 42. The heating roller 41 has a metal halogen lamp for heating purpose and is rotationally driven in the direction of the arrow (the clockwise direction) by means of an input of power from an unillustrated motor.

The press roller 42 is rotationally driven in the direction of the arrow (the counterclockwise direction) pursuant to the heating roller 41 while pressing the heating roller 41. The fixing section 18 thermally fixes the toner transferred onto the sheet 3 in the process cartridge 17 during the course of the sheet 3 passing between the heating roller 41 and the press roller 42 and subsequently delivers the sheet 3 to a sheet discharge path 44 by means of a conveyance roller 43. The sheet 3 delivered to the sheet discharge path 44 is sent to a discharge roller 45 and ejected onto a sheet discharging tray 46 by means of the discharge roller 45.

In order to generate an image on both sides of the sheet 3, the laser printer 1 is provided with a reverse conveyance section 47. The reverse conveyance section 47 has the discharge roller 45, a reverse conveyance path 48, a flapper 49, and a plurality of reverse conveyance rollers 50 and is configured so as to again send the sheet 3 having an image generated on a single side thereof between the photosensitive drum 27 and the transfer roller 30 by means of synergistic cooperation of these members, thereby generating images on both sides of the sheet 3.

2. Bias Application Circuit

FIG. 2 shows a block diagram of the configuration of the principal section of the bias application circuit 60. As mentioned previously, the bias application circuit 60 is for applying, to the transfer roller 30, a forward transfer bias voltage Va1 (a voltage of negative polarity) during forward transfer operation and a reverse transfer bias voltage Va2 (a voltage of positive polarity) during reverse transfer operation.

The bias application circuit 60 includes a CPU 61 serving as a control unit, a forward transfer bias application circuit 62 (an example power supply unit), and a reverse transfer bias application circuit 63. The respective bias application circuits 62 and 63 are connected in series to a connection line 90 connected to the roller shaft 30*a* of the transfer roller 30 in sequence of the forward transfer bias application circuit 62 and the reverse transfer bias application circuit 63. The bias application circuit 60 has an output detection circuit 83 (an example current detection unit) that outputs a detection signal S4 responsive to a current value (hereinafter called an "output current I") flowing to the connection line 90. The current of the forward transfer bias application circuit 62 is controlled by PWM (Pulse-Width Modulation) control of the CPU 61, whereas the reverse transfer bias application circuit 63 is subjected to constant-voltage control by means of PWM control of the CPU 61. The CPU 61 is connected to an operation section 95, by means of which the user performs various operations, and memory 100. The memory 100 stores information about a characteristic curve Z (an example characteristic line) to be described later.

(1) Forward Transfer Bias Application Circuit

The forward transfer bias application circuit 62 has a forward transfer PWM signal smoothing circuit 70, a forward transfer trans-drive circuit 71, a forward transfer boosting-and-smoothing rectifier circuit 72, and a forward transfer output voltage detection circuit 73 (an example voltage detection unit).

Of these circuits, the forward transfer PWM signal smoothing circuit 70 plays a role of receiving a PWM signal S1 from the PWM port 61*a* of the CPU 61 and smoothing and imparting the thus-received PWM signal to the forward transfer trans-drive circuit 71. The forward transfer trans-drive circuit 71 is configured so as to flow an oscillation current to a primary winding 75*b* of the forward transfer boosting-and-smoothing rectifier circuit 72 on the basis of the thus-received PWM signal S1.

The forward transfer boosting-and-smoothing rectifier circuit 72 has a transformer 75, a diode 76, a smoothing capacitor 77, and the like. The transformer 75 has a secondary winding 75*a*, a primary winding 75*b*, and an auxiliary winding 75*c*. One end of the secondary winding 75*a* is connected to the connection line 90 connected to the roller shaft 30*a* of the transfer roller 30 by way of the diode 76. In the meantime, the other end of the secondary winding 75*a* is connected to an output end of the reverse transfer bias application circuit 63. The smoothing capacitor 77 and the discharge resistor 78 are connected in parallel to the secondary winding 75*a*.

By means of such a configuration, the oscillation current of the primary winding 75*b* is boosted and rectified by the forward transfer boosting-and-smoothing rectifier circuit 72 and applied as the forward transfer bias voltage Va1 to the roller shaft 30*a* of the transfer roller 30 connected to an output terminal A of the bias application circuit 60.

The forward transfer output voltage detection circuit 73 is connected to the CPU 61 as well as to the auxiliary winding 75*c* of the transformer 75 of the forward transfer boosting-and-smoothing rectifier circuit 72. During forward transfer operation performed by the forward transfer bias application circuit 62, the CPU 61 is configured so as to detect the output voltage Vb developing in the auxiliary winding 75*c* and input the detection signal S2 to the A/D port 61*b* of the CPU 61.

(2) Reverse Transfer Bias Application Circuit

The reverse transfer bias application circuit 63 includes a reverse transfer PWM signal smoothing circuit 80, a reverse transfer trans-drive circuit 81, and a reverse transfer boosting-and-smoothing rectifier circuit 82.

Of these circuits, the reverse transfer PWM signal smoothing circuit 80 plays the role of receiving a PWM signal S3 from a PWM port 61*c* of the CPU 61 and smoothing and imparting the signal to the reverse transfer trans-drive circuit 81. The reverse transfer trans-drive circuit 81 is configured to flow an oscillation current to the primary winding 85*b* of the reverse transfer boosting-and-smoothing rectifier circuit 82 in accordance with the received PWM signal S3.

The reverse transfer boosting-and-smoothing rectifier circuit 82 includes a transformer 85, a diode 86, a smoothing capacitor 87, and the like. The transformer 85 includes a secondary winding 85*a*, a primary winding 85*b*, and an auxiliary winding 85*c*. One end of the secondary winding 85*a* is connected to the other end of the secondary winding 75*a* of the forward transfer bias application circuit 62 by way of the diode 86. In the meantime, the other end of the secondary winding 85*a* is connected to a ground by way of the resistor 91. A smoothing capacitor 87 and a pair of resistors 88 and 89 are connected in parallel to the secondary winding 85*a*. In the embodiment, one resistor 89 of the pair of resistors 88 and 89 is taken as a detection resistor and configured such that a detection signal S4 responsive to the output current I flowing through the detection resistor 89 is fed back to the A/D port 61*d* of the CPU 61.

By means of such a configuration, an oscillation current of the primary winding 85*b* is boosted and rectified by the reverse transfer boosting-and-smoothing rectifier circuit 82 and applied as the reverse transfer bias current Va2 to the roller shaft 30*a* of the transfer roller 30 connected to the output terminal A of the bias application circuit 60.

As above, while driving the forward transfer bias application circuit 62 during forward transfer operation by imparting the circuit with a PWM signal S1, the CPU 61 performs current control for outputting the PWM signal S1, whose duty ratio is changed as required, to the forward transfer PWM signal smoothing circuit 70 such that the output current I comes to an optimum output current Ib, which is a control target value to be described later, in accordance with the detection signal S4.

Further, while driving the reverse transfer bias application circuit 63 during reverse transfer operation by imparting the circuit with a PWM signal S3, the CPU 61 performs constant voltage control for outputting the PWM signal S3 whose duty ratio is changed, as required, to the reverse transfer PWM signal smoothing circuit 80 such that a load voltage value comes to a predetermined constant voltage in accordance with a detection signal S4 conforming to the load voltage of the detection resistor 89.

3. Details on Forward Transfer Operation

Even in the laser printer 1 of the present embodiment, resistance values of the transfer roller 30, the photosensitive drum 27, and the sheet 3 nipped between the roller 30 and the drum 27 can vary depending on an ambient environment, such as a temperature and humidity (especially humidity). Accordingly, during forward transfer operation, a transfer failure may arise unless optimum power supply is performed in response to a change in the ambient environment. The transfer failure refers to a state where either splashing or a remainder left after transfer attributable to deficient transfer power and electric discharge attributable to excess transfer power arises and where the thus-arisen problem substantially affects print quality.

Accordingly, in the present embodiment, a value of an electric current flowing to the transfer roller 30, the photosensitive drum 27, and the sheet 3; namely, the output current I indicated by the detection signal S4 from the output detection circuit 83 (an example electric current imparted to the transfer unit), is taken as a control target. The duty ratio of the PWM signal S1 is increased or decreased such that the output current I comes to an optimum value derived from a characteristic curve Z to be described later.

(1) About Characteristic Line

The characteristic curve Z of the present embodiment is a curve obtained by experimentally determining an optimum output current Ib (an example optimum value to be controlled) corresponding to the load resistance value Ri (an example electric characteristic value) of the transfer roller 30, the photosensitive drum 27, and the sheet 3 nipped between them and approximating the thus-determined current value.

Figure 3:
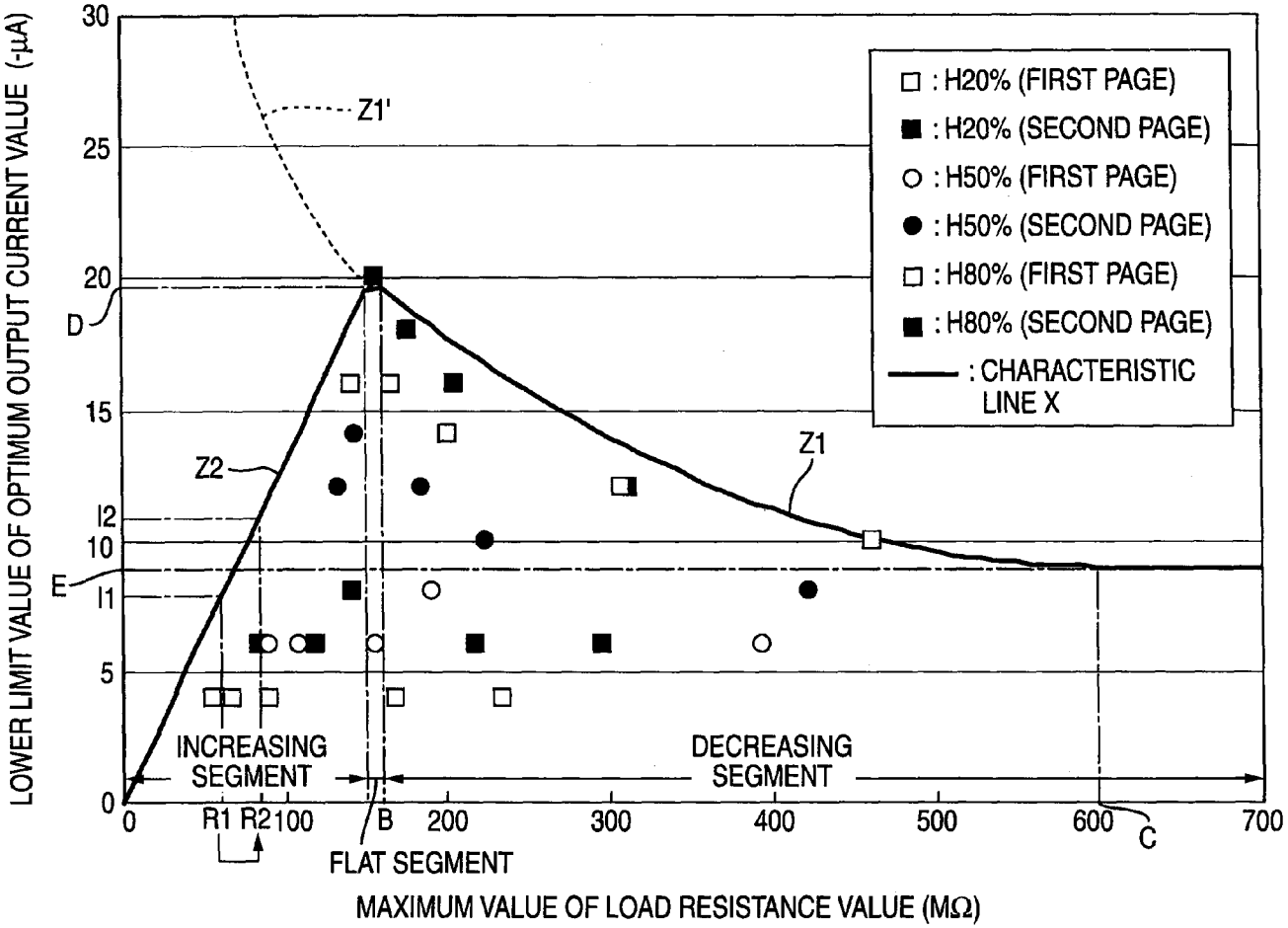
FIG. 3 is a graph showing respective test results (a lower limit value of an optimum output current value) and a characteristic curve.
Figure 4:
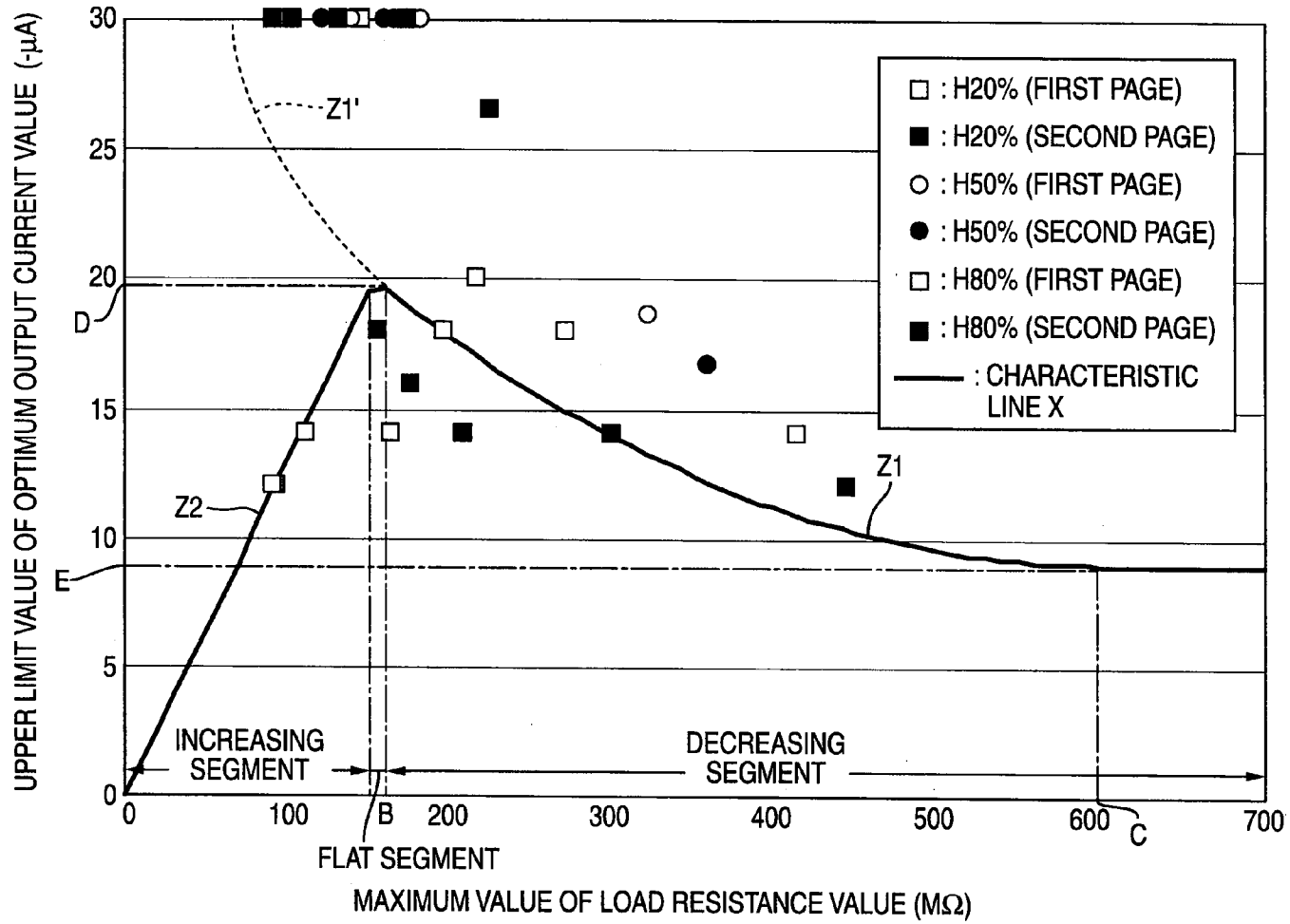
FIG. 4 is a graph showing respective test results (an upper limit value of an optimum output current value) and a characteristic curve.

FIGS. 3 and 4 show plots (indicated by circles and squares in the respective drawings) of test results and the characteristic curve Z derived by approximating the plots. Respective plots of FIG. 3 show results of measurement of the maximum load resistance value Ri and the lower limit value of the optimum output current value Ib acquired at each of humidity levels (e.g., 20%, 50%, and 80%) and respective temperatures. Specifically, foregoing double-sided printing is carried out while the absolute value of the output currents I is gradually increased at respective humidity levels and temperatures from a comparatively-small value. The maximum load resistance value Ri acquired during the print process is measured, and an output electric current I acquired when a transfer failure does not essentially arise in a print result on the sheet 3 is also measured. The thus-measured current is taken as the lower limit value of the optimum output current value Ib.

In the meantime, respective plots shown in FIG. 4 correspond to results of measurement of the maximum load resistance value Ri and the upper limit of the optimum output current Ib performed at respective humidities (e.g., 20%, 50%, and 80%) and temperatures. Specifically, double-sided printing is carried out while the absolute value of the output currents I is gradually decreased at respective humidity levels and temperatures from a comparatively-large value. The maximum load resistance value Ri acquired during the print process is measured, and an output electric current I acquired when a transfer failure does not essentially arise in a print result on the sheet 3 is also measured. The thus-measured current is taken as the upper limit value of the optimum output current value Ib. In the respective drawings, plots with outlined symbols represent a test result achieved during printing of a first page of the sheet 3, and plots with solid symbols show a test result achieved during printing of a second page of the sheet 3.

Test results shown in FIGS. 3 and 4 show the following.

In a segment where the large load resistance value Ri is acquired, the degree of dissociation between an area (an area between the upper limit value and the lower limit value) of the optimum output current Ib acquired at high humidity (e.g., 80%) and an area of the optimum output current value Ib acquired at low humidity (e.g., 20%) is small.

In a segment where the load resistance value Ri is small, it may be the case where a large degree of dissociation will arise between the area of the optimum output current Ib acquired at high humidity and the area of the optimum output current Ib acquired at low humidity.

In this regard, the present inventors have hitherto considered that, as the load resistance value Ri becomes smaller, the resistance value of the sheet 3 against the resistance value of the transfer roller 30 becomes greater and that the absolute value of the optimum output current value Ib eventually becomes greater. Incidentally, the test results show that the resistance value of the transfer roller 30 and the resistance value of the sheet 3 become approximately equal to each other at; particularly, high temperature and high humidity, in spite of the small load resistance value Ri and the absolute value of the optimum output current value Ib does not necessarily increase.

Accordingly, the characteristic curve Z adopted in the present embodiment is taken as a line showing a relationship by means of which a change in the absolute value of the optimum output current value Ib shifts from an increasing tendency to a decreasing tendency with an increase in load resistance value Ri. In the characteristic curve Z, a segment of the increasing tendency is hereinbelow called an "increasing segment," and a segment of the decreasing tendency is hereinbelow called a "decreasing segment."

(a) About the Decreasing Segment

As mentioned above, the decreasing segment is a segment where the load resistance value Ri is comparatively large and where a small degree of dissociation exists between the range of the optimum output current Ib acquired at high humidity and the range of the optimum output current Ib acquired at low humidity.

The decreasing segment of the characteristic curve Z is a curve determined by approximating, through use of a power function ($y=A\times B$, where there stands a relationship of the coefficient $B<0$), respective plots (e.g., solid symbols) achieved when an ambient temperature is changed at the lowest humidity (e.g., 20% in the present embodiment) under a recommended use condition submitted by the manufacturer of the laser printer 1.

Figure 5:
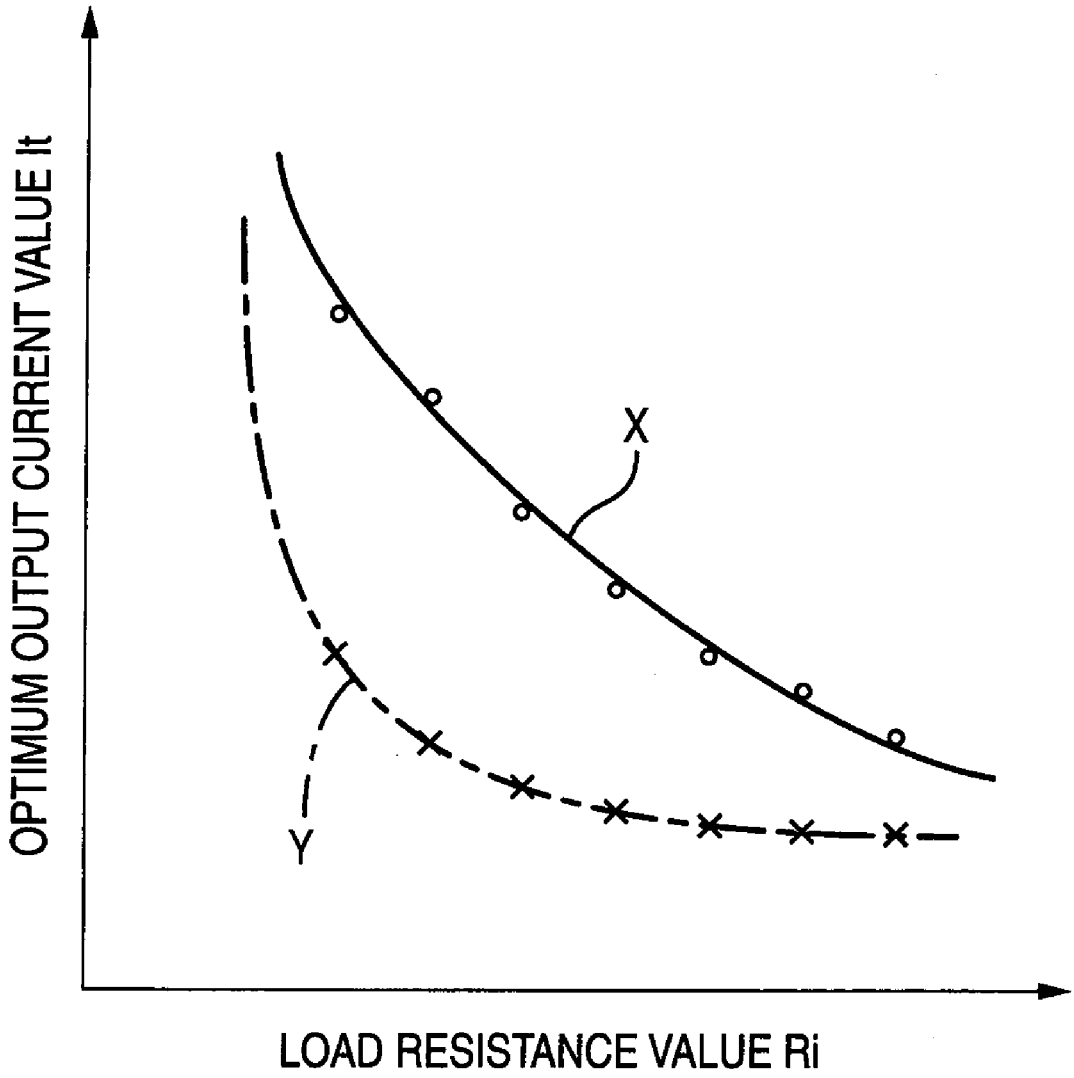
FIG. 5 is a descriptive view showing the correlation between a load resistance value and an optimum output current value.

Reasons for utilization of plots acquired at the lowest humidity are as follows. The load resistance value Ri acquired during operation for transferring an image to the sheet 3 usually, greatly changes depending on humidity rather than on temperature. A test result yielded when the optimum output current value Ib for the load resistance values Ri is changed according to a temperature and humidity approximately becomes as shown in FIG. 5. A graph X in the drawing is a curve obtained by approximating a test result yielded when the temperature is changed at the lowest humidity under the recommended use conditions (e.g., 20%). Meanwhile, a graph Y is a curve obtained by approximating a test result yielded when the temperature is changed at the highest humidity (e.g., 80%) under the recommended use conditions.

As is evident from the results, when there is adopted a characteristic curve Y derived from the test result yielded at the highest humidity, there may arise a transfer failure, such as a so-called transfer residual ghost; that is, residual toner left as a result of insufficient transfer of toner to a preceding sheet 3 because of a deficiency in a transfer current induced when low humidity is achieved adheres to the next sheet 3 that will contact the photosensitive drum 27 after one rotation of the photosensitive drum.

In contrast, in a case where there is adopted a characteristic curve Z derived from a test result yielded at the lowest humidity, it is experimentally ascertained that, even when high humidity is achieved, the degree of dissociation between the optimum output current value Ib acquired at high humidity and the optimum output current value Ib acquired at low humidity is small within a decreasing segment where the load resistance value Ri has a certain degree of magnitude; and that an electric discharge induced by excessive transfer power does not substantially affect print quality. Therefore, a curve based on the test result acquired at the lowest humidity (hereinafter called a "decreasing segment line Z1") is adopted for the decreasing segment of the characteristic curve Z.

The decreasing segment line Z1 is a curve determined by approximating the plot P of the respective test results yielded at the lowest humidity through use of the power function (y=A×B, where there stands a relationship of the coefficient B<0) and can be expressed by the following mathematical expression 1.

$$\text{Optimum output current } Ib=A\cdot(Ri-B)2+C \quad \text{(Mathematical Expression 1)}$$

Ib=D when Ri is B or less;

Ib=E when Ri is C or more—

Ri is a detected load resistance value

A to E are coefficients: there stands a relationship of A, D, E<0, and there stands a relationship of B, C>0 (a relationship of A, D, E>0 stands when the forward transfer bias voltage Va1 is of positive polarity)

(b) About the Increasing Segment

As mentioned previously, the increasing segment is a segment where the load resistance value Ri is comparatively small and where a large degree of dissociation exists between the area of the optimum output current value Ib acquired at high humidity and the area of the optimum output current Ib acquired at low humidity. Therefore, when a line (see a line interconnecting solid square plots obtained at a humidity of 20% in FIG. 3) that is an extension of the decreasing segment line Z1 is utilized even in the increasing segment, the following problem arises. The decreasing segment line Z1 is merely derived from a test result yielded at the lowest humidity. Accordingly, when an optimum output current value is determined by utilization of the extension of the decreasing segment line Z1, the optimum output current value may greatly surpass; in particular, the upper limit value of the original optimum output current value Ib acquired at a high temperature and high humidity. Specifically, as shown in FIGS. 3 and 4, when humidity is 80% and when the load resistance value Ri is in the vicinity of 100 [MΩ], the optimum output current value determined by the extension of the decreasing segment line Z1 becomes about triple or more the upper limit value of the original optimum output current value Ib, which may raise a considerably high possibility of occurrence of a transfer failure.

It is possible to ascertain from the test results shown in FIGS. 3 and 4 that a group of areas of the optimum output current values Ib acquired at respective humidity levels in the increasing segment shows a tendency of the optimum output current Ib to increase with an increasing load resistance value Ri. Accordingly, there is adopted, in the increasing segment, a line (hereinbelow called an "increasing segment line Z2") defined by approximating plots (plots acquired at high and low humidity levels) located within the increasing segment. The increasing segment line Z2 can be expressed by the following mathematical expression 2.

$$\text{Optimum output current } Ib=F\cdot Ri+G \quad \text{(Mathematical Expression 2)}$$

where F and G are coefficients: there stands a relationship of F, G<0 (a relationship of F, G>0 stands when the forward transfer bias voltage Va1 is of positive polarity).

(c) Relationship Between the Decreasing Segment Line and the Increasing Segment Line The following relationship stands between the decreasing segment line Z1 and the increasing segment line Z2.

When |the optimum output current value Ib of Z1| (an absolute value) is smaller than |the optimum output current value Ib of Z2|, the optimum output current value Ib of Z1 is adopted. When |the optimum output current value Ib of Z1| (an absolute value) is equal to or greater than |the optimum output current value Ib of Z2|, the optimum output current value Ib of Z2 is adopted.

An average inclination of the increasing segment line Z2 (an amount of increase or decrease in optimum output current value per unit load resistance value) is set so as to become greater than an average inclination of the decreasing segment line Z1.

The characteristic curve Z is set so as to shift from the increasing segment line Z2 to the decreasing segment line Z1 while a plot acquired when the second page is printed at low humidity (e.g., 20%) is taken as a threshold.

Figure 6:
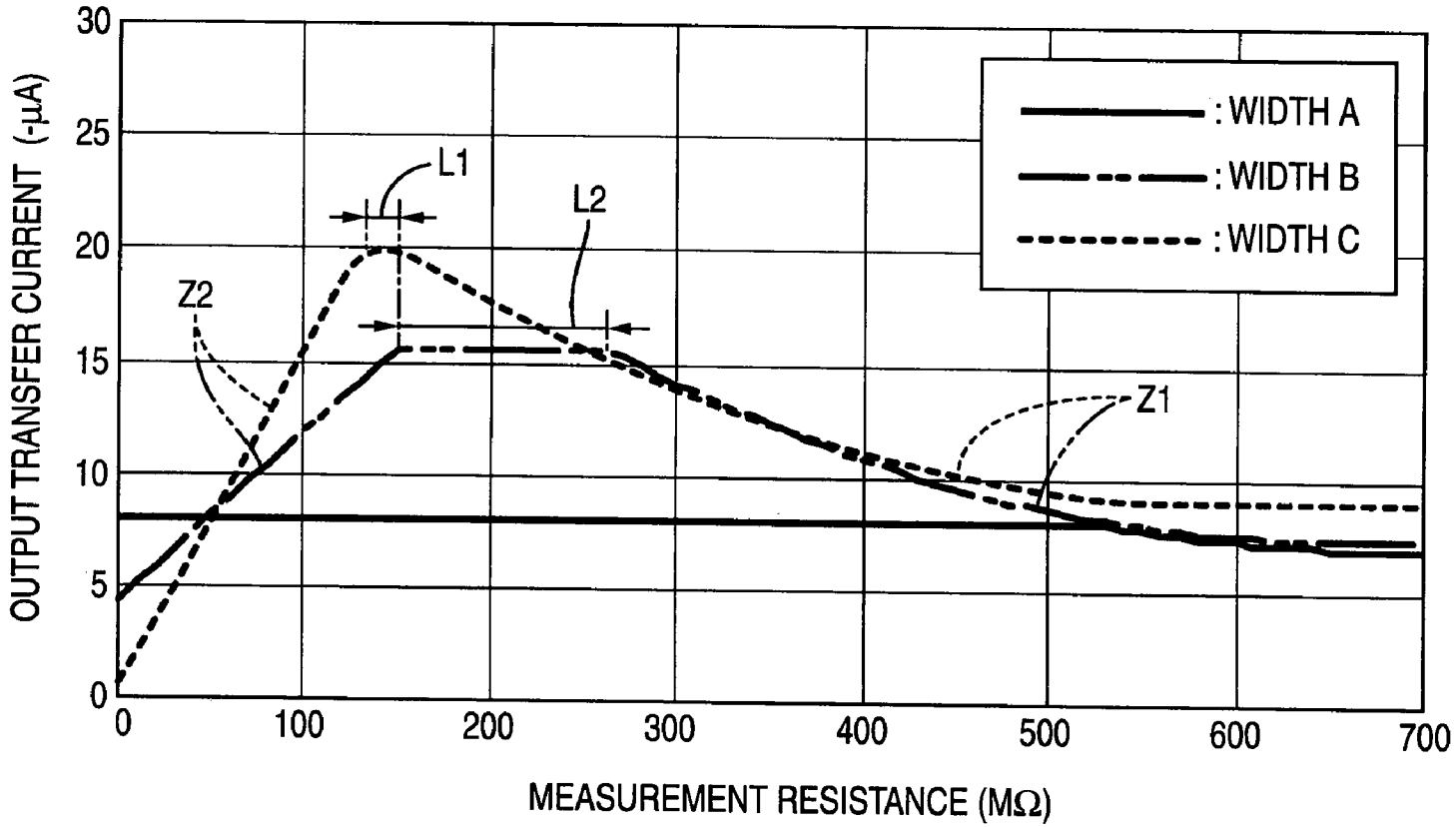
FIG. 6 is a graph showing a relationship between the width of cardboard and a characteristic line.
Figure 7:
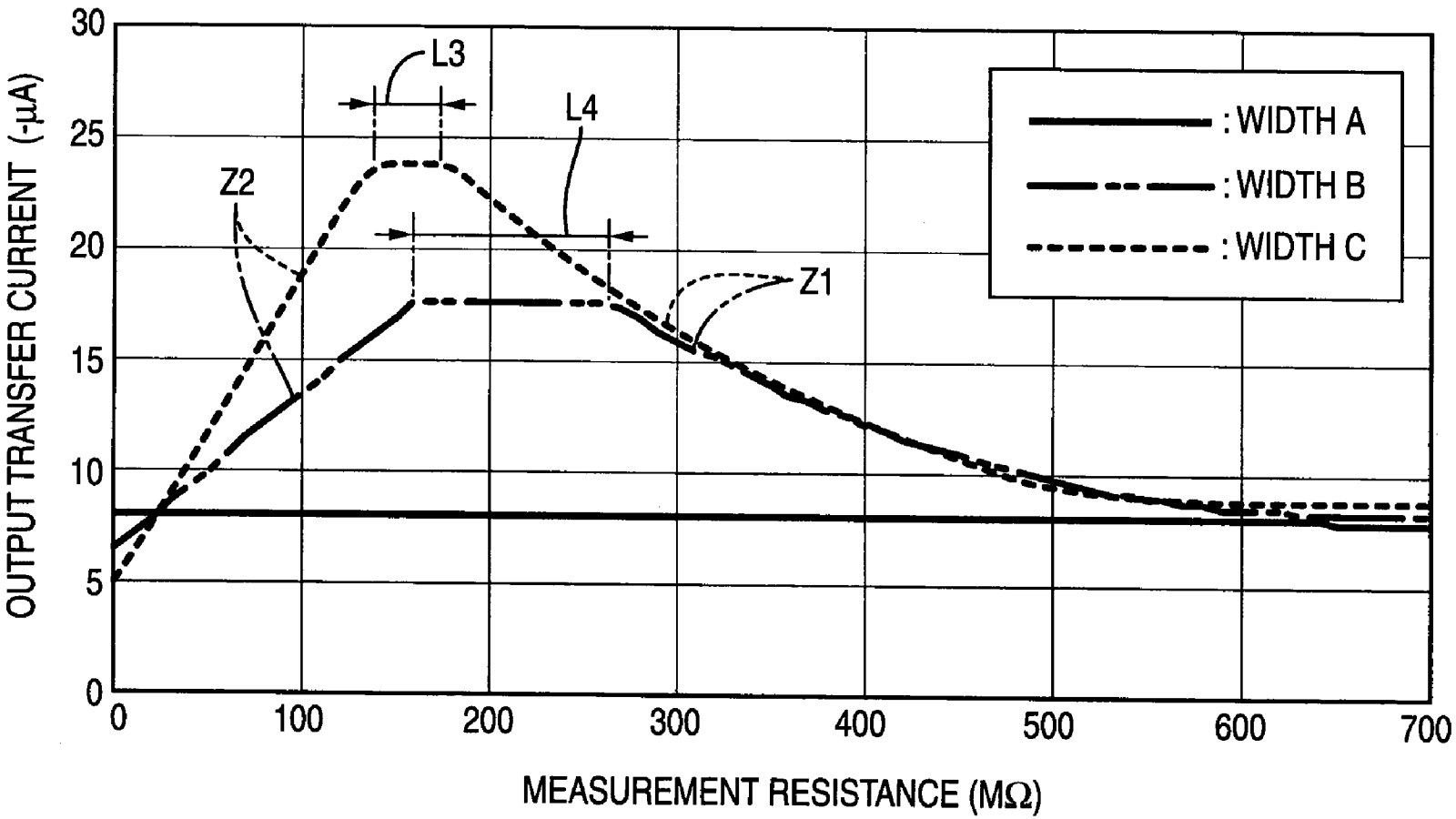
FIG. 7 is a graph showing a relationship between the width of an envelope and a characteristic line.
Figure 8:
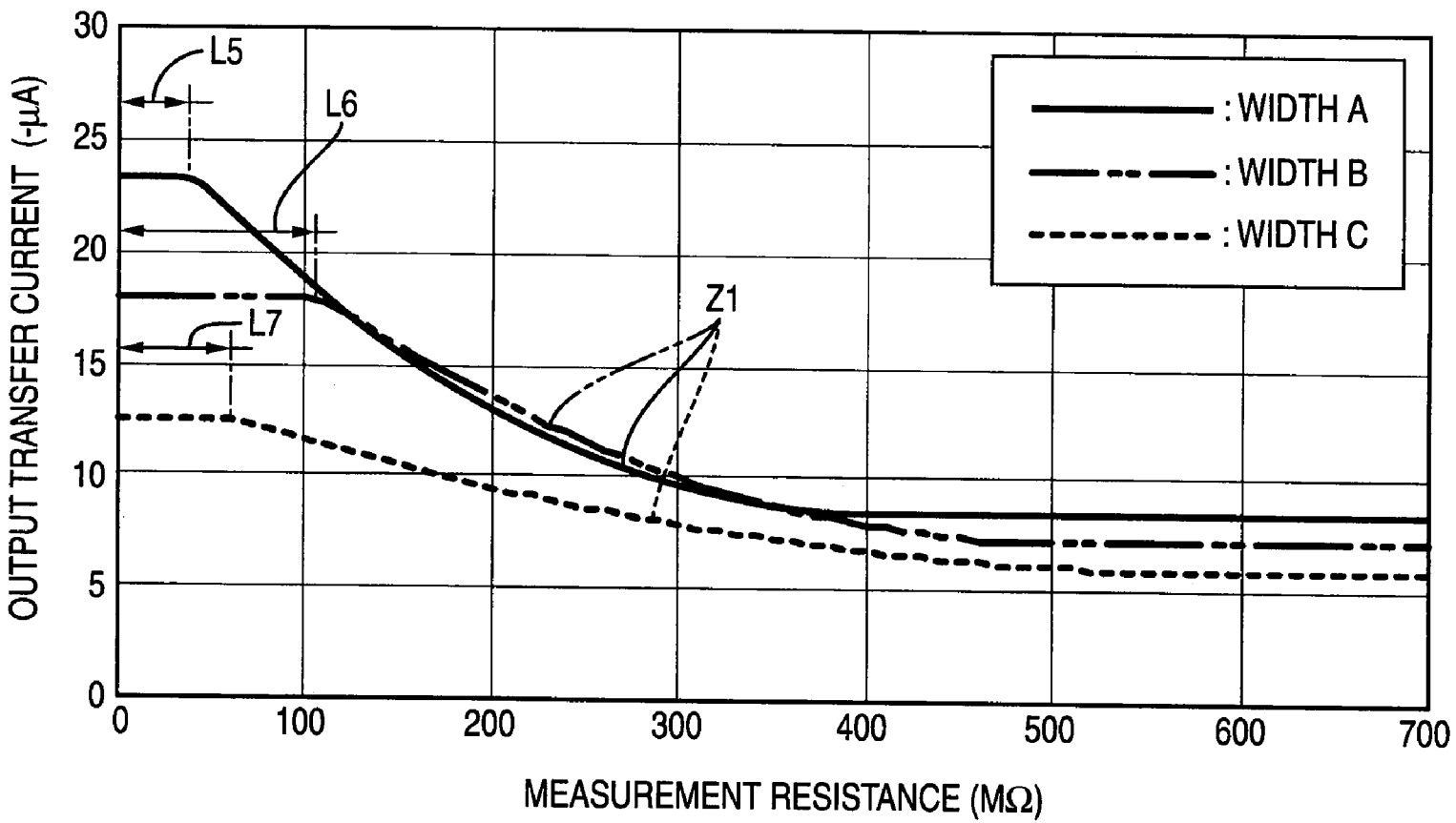
FIG. 8 is a graph showing a relationship between the width of plain paper and a characteristic line.

(d) Relationship Between the Type of a Recording Medium and a Characteristic Curve FIGS. 6 to 8 are graphs showing a relationship between the width of each recording medium (a width achieved in a sub-scan direction orthogonal to the direction of conveyance, which is hereinafter simply called a "sheet width") and a characteristic curve when the recording medium is cardboard (e.g., a postcard or bond paper), an envelope, or plain paper (e.g., commonly-used copy paper). Respective characteristic curves are acquired by conducting the foregoing test while the type of the recording medium (a material, a sheet width, and a thickness) is changed. Throughout the drawings, there stands a relationship of Width A>Width B>Width C.

As can be seen from the respective drawings, in a case where the sheet width is Width A, even when a change occurs in the load resistance value Ri, any substantial changes do not arise in the optimum output current value Ib. In contrast, as the sheet width becomes narrow, the characteristic curve z assumes an undulating shape. In particular, in relation to a characteristic curve of Width B and a characteristic curve of Width C, a flat segment where the optimum output current value Ib is essentially constant noticeably appears in an area between the increasing segment line Z2 and the decreasing segment line Z1.

In this flat segment, the area of the optimum output current value Ib acquired at high humidity and the area of the optimum output current value Ib acquired at low humidity essentially overlap each other, and an optimum output current value Ib can be set to a certain constant level regardless of the load resistance value Ri. In such a segment, it is preferable to make the optimum output current value Ib as stable as possible within a predetermined range, thereby stabilizing power supply control. For these reasons, each of the characteristic curves Z includes a flat segment. The length L (L1 to L7) of the flat segment changes according to the type of a recording medium (especially a sheet width). In a case where a recording medium is cardboard or an envelope having a certain degree of thickness, the length L of the flat segment tends to become shorter as the sheet width becomes narrow.

As shown in FIG. 8, in the case of plain paper, dissociation between the area of the optimum output current value Ib acquired at high humidity and the area of the optimum output current value Ib acquired at low humidity is small even in a segment where the load resistance value Ri is small. Accordingly, when the recording medium is plain paper, the a monotonous line having only the flat segment and the decreasing segment and not having the increasing segment is taken as a characteristic line for deriving the optimum output current value Ib.

In the present embodiment, information about a characteristic line conforming to each type of a recording medium is stored in memory 100. The CPU 61 ascertains the type of a recording medium of current print target and derives an optimum output current value Ib by utilization of a characteristic line conforming to the type. The CPU 61 can ascertain the type of a recording medium according to a print condition, or the like, set by the user by way of, e.g., the operation section 95. When there is a sensor capable of ascertaining the type of the sheet 3 loaded in the sheet feeding tray 6, ascertainment can also be performed on the basis of a result of detection of the sensor.

(e) About an Arithmetic Expression for Computing a Characteristic Curve

At least one of coefficients A, B, C, F, and G of an arithmetic expression (Mathematical Expressions 1 and 2) showing the respective characteristic lines of the embodiment is stored in the memory 100 as a function showing a relationship between a sheet width and a coefficient corresponding thereto. The function can be obtained by approximating plots that are determined from a sheet width and an optimum coefficient for the sheet width. It is seen that a correlation exists between a coefficient F and a sheet width as shown in FIGS. 6 and 7. Accordingly, the coefficient F can be derived from the function of the sheet width. By means of such a configuration, a plurality of coefficients F corresponding to respective sheet widths do not need to be stored in the memory 100, thereby facilitating management of parameters. Further, a characteristic curve corresponding to a consecutive change in sheet width in detail can be utilized.

(2) Specifics of Control

The CPU 61 captures the detection signals S2 and S4 at predetermined control timing, thereby computing a current load resistance value Ri, deriving an optimum output current value Ib corresponding to the thus-computed load resistance value Ri through use of the characteristic curve Z, and determining the optimum output current value Ib as a control target value. At this time, the CPU 61 functions as a determination unit and an ascertainment unit. A PWM signal S1 whose duty ratio is increased or decreased in accordance with an amount of difference between the optimum output current value Ib serving as the control target value and the current output current value I is output at the next control timing.

Specifically, for instance, the CPU 61 computes the load resistance value Ri from the detection signals S2 and S4. Specifically, the CPU 61 detects, on the basis of the detection signal S4, the value of the output current I flowing to the transfer roller 30, or the like. An output voltage Vb developing from the auxiliary winding 75*c* is detected on the basis of the detection signal S2. As indicated by Mathematical Expression 3, an application voltage value Vi applied to the transfer roller 30 can be determined by addition of the voltage Vc, which is determined by multiplying the output voltage Vb by a voltage ratio "n" of the auxiliary winding 75*c* to the secondary winding 75*a*, to a voltage Vd, which is determined by multiplying the resistance values of resistors 88 and 89 by the output current I. A value determined by dividing the application voltage value Vi by the output current I is taken as a load resistance value Ri under the current environment.

$$\text{Load resistance value } Ri=\{n*Vb+(r1+r2)*Vd\}/I \quad \text{(Mathematical Expression 3)}$$

Where r1 is a resistance value of the resistor 88 and r2 is a resistance value of the resistor 89.

Next, the CPU 61 computes, by means of the characteristic curve Z, an optimum output current value Ib corresponding to the thus-computed current load resistance value Ri. The present embodiment is configured such that information about the characteristic curve Z is stored as function information about Mathematical Expression 1 in the memory 100 and that the CPU 61 reads information about the characteristic curve Z from the memory 100 and computers the optimum output current value Ib.

Figure 9:
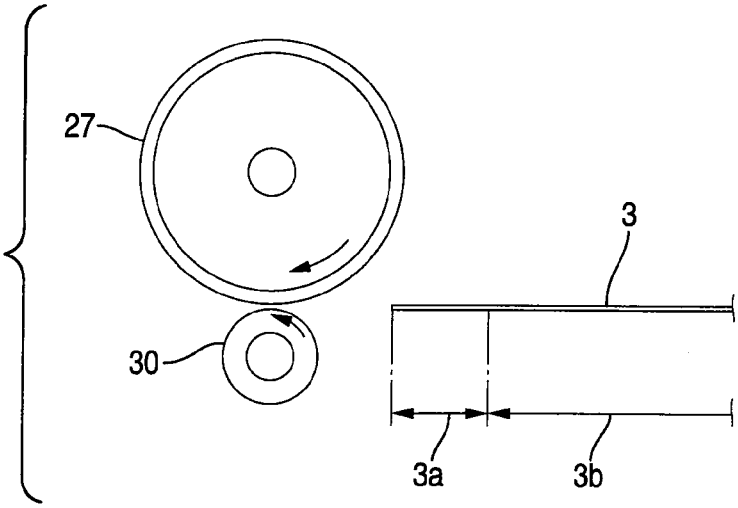
FIG. 9 is a schematic view (part 1) for describing the position of a sheet with respect to a transfer position.

As shown in FIGS. 3 and 9, in a state (see FIG. 9) where the sheet 3 enters the transfer position where the photosensitive drum 27 opposes the transfer roller 30, the load resistance value is assumed to be R1, and the an output current value acquired at this time is assumed to be I1. As a result of the leading end 3*a* of the sheet 3 entering the transfer position at the next control timing (FIG. 10), a value of the current load resistance to the transfer roller 30 changes to R2, and a temporary drop arises in the current output current value along with the change. The CPU 61 computes, from the characteristic curve Z, the optimum output current value I2 corresponding to the current load resistance value R2.

The CPU 61 determines, by means of Mathematical Expression 4 provided below, a duty ratio Dt of the PWM signal S1 to be output at the next control timing.

$$\text{Next duty ratio } Dt=Di+(I2-I1')*K \quad \text{(Mathematical Expression 4)}$$

Di: Current duty ratio

I2−I1': an amount of difference between an optimum output current value and a current output current value K: Coefficient As a result, the optimum output current value "I2" corresponding to the load resistance value "R2" acquired after fluctuation attributable to presence of the sheet 3 is imparted to the transfer roller 30, and the like, until when a center 3*b* of the sheet 3 comes to a transfer position. Accordingly, occurrence of a transfer failure due to fluctuations in load resistance value can be avoided.

(3) Control Timing

Figure 10:
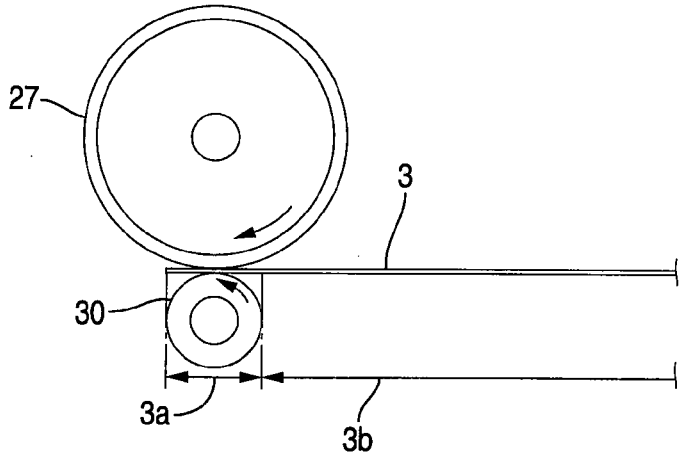
FIG. 10 is a schematic view (part 2) for describing the position of the sheet with respect to the transfer position.
Figure 11:
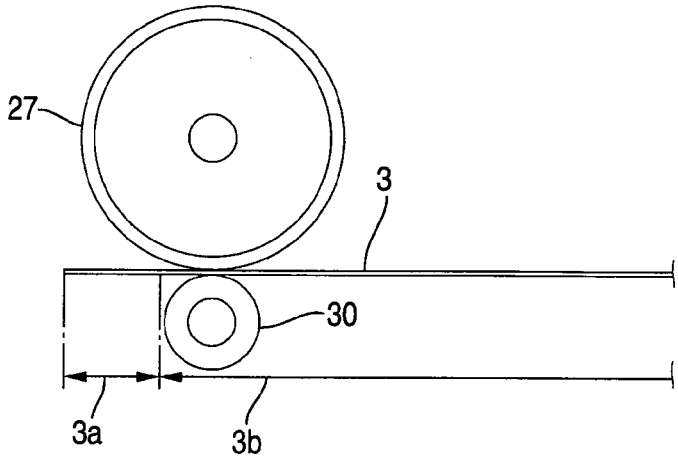
FIG. 11 is a schematic view (part 3) for describing the position of the sheet with respect to the transfer position.

In the image forming apparatus, such as the laser printer 1, the center of the sheet 3 except four edges is defined as a printable area (an image generative area), and printing is performed in the printable area. The edge 3*a* of the sheet 3 in FIGS. 9 through 11 is an unprintable area, and the center 3*b* is a printable area. In the present embodiment, the control timing of the CPU 61 is set so as to become shorter than a period of time from when the leading end of the sheet 3 arrives at the transfer position until when the leading end reaches the printable area of the sheet 3.

Specifically, the foregoing control operation is performed at least once from when a fluctuation arises in the load resistance value Ri as a result of the leading end of the sheet 3 beginning to enter the transfer position and in the middle of the edge 3*a*, which is an unprintable area of the sheet 3, passing through the transfer position. The center 3*b*, which is a printable area of the sheet 3, can be subjected to transfer operation at the optimum output current value Ib corresponding to the changed load resistance value Ri. The control timing is determined by the speed of conveyance of the sheet 3 and the length of the sheet in the direction of conveyance within the unprintable area.

4. Advantages of the Embodiment (1) As mentioned previously, the inventors of the present invention found, by means of the test, the fact that the absolute value of an optimum value of a control target tends to decrease at low humidity with an increase in load resistance value Ri and that, on the contrary, the absolute value of the optimum output current value Ib tends to increase with an increase in the detection value at high humidity. Accordingly, the present embodiment is configured such that an optimum output current value Ib for the current environment is determined by utilization of a characteristic line Z showing a relationship of a change in the absolute value of the optimum output current value Ib shifting from an increasing tendency to a decreasing tendency with an increase in load resistance value Ri. As a result, when compared with the related-art image forming apparatus utilizing a characteristic line of a monotonous increasing tendency, a decrease in image quality, which would otherwise be caused by a change in humidity, can be prevented.

(2) According to the type of a recording medium (a material, a thickness, a size, and the like), a great change arises in the optimum output current Ib for one recording medium in accordance with a change in humidity, and no essential change arises in the optimum output current Ib for another recording medium in accordance with the change in humidity. When there are areas that are not so different from each other, an optimum value for the area is made as stably as possible within a predetermined range, and power supply control should be stabilized. Accordingly, the present embodiment is configured such that an optimum value is determined by utilization of a characteristic line whose flat segment changes in length according to the type of a recording medium. In some type of the recording medium, the optimum output current Ib is determined by utilization of a monotonous line not having an increasing segment line Z2 rather than utilization of the characteristic curve Z having both the increasing segment line Z2 and the decreasing segment line Z1. As a result, power supply control can be simplified according to the type of the recording medium.

(3) When variations exist in the state of humidity of one sheet 3, the load resistance value Ri changes according to a location on the sheet 3. Therefore, in the present embodiment, an output current I that is a control target is controlled at control timing of a time interval that is shorter than a time of operation for subjecting the entirety of one sheet 3 to transfer operation (specifically, a time from when the leading end of the sheet 3 arrives at the transfer position until when the trailing end of the sheet 3 passes through the transfer position), thereby enabling optimum transfer at each position on the sheet.

(4) Further, in the present embodiment, the control timing of the CPU 61 is set so as to become shorter than the time from when the leading end of the sheet 3 arrives at the transfer position until when the printable area of the sheet 3 arrives at the transfer position. Therefore, transfer operation can be performed at an optimum output current value Ib within the printable area of the sheet 3. There may also be adopted a configuration in which power control is performed by only the leading end of the sheet 3 or over the entire length of the sheet 3 in the direction of conveyance of the sheet.

Other Embodiments

The present invention is not limited to the foregoing descriptions as well as to the embodiment described by reference to the drawings. For instance, the following embodiments fall within the technical scope of the present invention. In addition to practiced as mentioned above, the present invention can also be performed while variously modified without departing from the gist of the invention.

Figure 12:
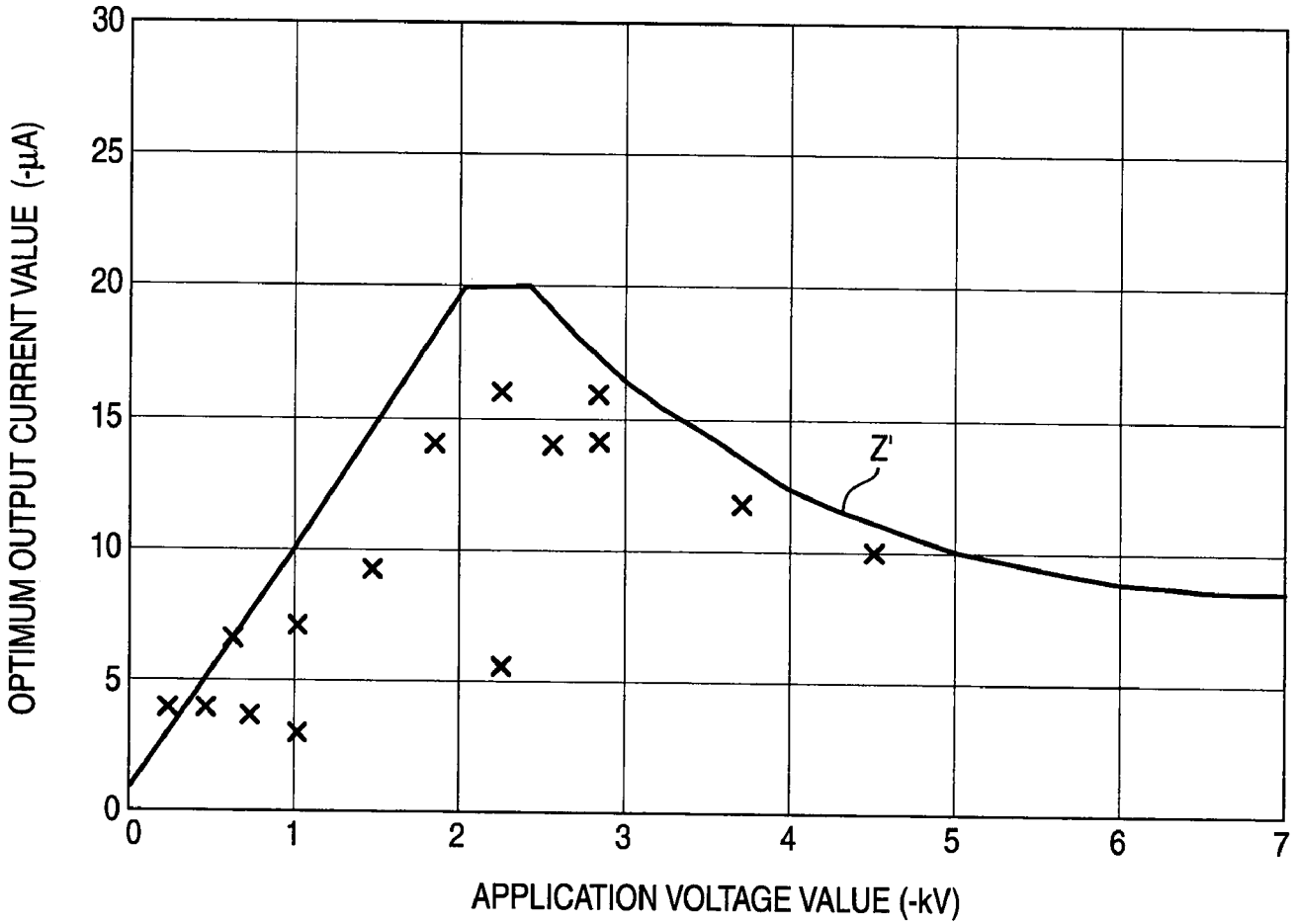
FIG. 12 is a graph showing respective test results of modifications and a characteristic curve.

(1) In the embodiment, there is adopted the characteristic line Z, and the like, showing the correlation between the load resistance value Ri and a corresponding optimum output current value Ib. In addition to the characteristic line, a characteristic curve Z' showing the correlation between the application voltage value Vi (an example value detected by the voltage detection unit) and a corresponding optimum output current Ib may also be used. FIG. 12 shows the characteristic curve Z' achieved when the recording medium is a postcard.

(2) In the embodiment, the increasing segment line Z2 is taken as a linear function employing linear approximation. However, the function is not limited to the linear function. As a matter of course, a curved function utilizing power function ($y=A\times B$) approximation (logarithmic approximation), trigonometric function approximation, and the like, may also be adopted. Moreover, the decreasing segment line Z1 is derived by means of a secondary function utilizing power function ($y=A\times B$) approximation (logarithmic approximation). However, the approximation is not limited to the function and may also be a linear approximation or a trigonometric function approximation.

(3) The "image forming apparatus" includes a facsimile and a multifunction machine having a printer function, a scanner function, and the like, as well as including a printer (a laser printer). Moreover, the "recording medium" includes; for instance, an OHP sheet, in addition to the sheet.

(4) The "image generative area" signifies an area on the recording medium where given image formation quality is assured; normally, an area except a marginal area of a recording medium.

(5) In the embodiment, the load resistance value Ri determined by dividing the application voltage value Vi by the output current value I is taken as an electric characteristic value. However, there may also be adopted a configuration in which the application voltage value Vi and the output current value I are taken as an "electric characteristic value" without obtaining the load resistance value Ri as a computation result.

As described above, an image forming apparatus of the first aspect of the present invention comprising: a transfer unit for transferring a toner image carried on an image carrier to a recording medium; a power supply unit that, while taking a current value imparted to the transfer unit as a control target, supplies power conforming to the control target value to the transfer unit; a voltage detection unit for detecting a voltage value for the transfer unit; a current detection unit for detecting a value of a current flowing to the transfer unit; and a determination unit that acquires a detection value of the voltage detection unit and a detection value of the current detection unit and that determines, as a control target value for the power supply unit, an optimum value of a control target derived from a characteristic line showing a relationship between an electric characteristic value based on both detection values or a detection value of the voltage detection unit and an optimum value of the control target, wherein the characteristic line is a line showing a relationship of a change in absolute value of an optimum value of the control target shifting from an increasing tendency to a decreasing tendency with an increase in an absolute value of the electrical characteristic value or an absolute value of the detection value of the voltage detection unit.

The inventors of the present invention found, by means of a test, the fact that the absolute value of an optimum value of a control target tends to decrease at low humidity with an increase in an absolute value of an electrical characteristic value based on a current value and a voltage value or an absolute value of a detection value of a voltage detection unit (hereinafter often called simply a "detection value") and that, on the contrary, the absolute value of the optimum value of the control target tends to increase with an increase in the detection value at high humidity.

Accordingly, the present invention is configured such that an optimum value of the control target is determined by utilization of a characteristic line showing a relationship of a change in the absolute value of the optimum value of the control target shifting from an increasing tendency to a decreasing tendency with an increase in the absolute value of a detection value. As a result, when compared with the related-art image forming apparatus utilizing a characteristic line of a monotonous increasing tendency, a decrease in image quality, which would otherwise be caused by a change in humidity, can be prevented.

A second invention is directed toward the image forming apparatus of the first invention, wherein the apparatus further includes an ascertainment unit for ascertaining a type of the recording medium; the characteristic line has a flat segment, where the optimum value falls within a predetermined range, between a segment of increasing tendency and a segment of the decreasing tendency; and the determination unit determines the optimum value by utilization of a characteristic line whose flat segment differs in length according to the type of the recording medium ascertained by the ascertainment unit.

According to the type of a recording medium (a material, a thickness, a size, and the like), a great change arises in an optimum value of a control target in one recording medium by reason of a change in humidity, but a not-so-great difference arises in the optimum value in another recording medium. When there are areas that do not much differ from each other, an optimum value for the areas should be made as stable as possible within a predetermined range, thereby stabilizing power supply control. Accordingly, the present invention is configured such that an optimum value is determined by utilization of a characteristic line whose flat segment changes in length according to the type of a recording medium.

A third invention is directed toward the image forming apparatus of the first invention or the second invention further including an ascertainment unit for ascertaining the type of the recording medium, and the determination unit selects, according to the type of the recording medium ascertained by the ascertainment unit, the characteristic line or a monotonous line along which a change in an absolute value of an optimum value of the control target does not reversely increase or decrease with an increase in the electrical characteristic value or an absolute value of a detection value of the voltage detection unit, to thus determine the optimum value.

According to the type of a recording medium (a material, a thickness, a size, and the like), a great change arises in an optimum value of a control target in one recording medium by reason of a change in humidity, but a not-so-great difference arises in the optimum value in another recording medium. Therefore, in the present embodiment, the optimum value is determined for some type of the recording medium by utilization of a monotonous line having either the increasing tendency or the decreasing tendency rather than utilization of the characteristic line having both the increasing tendency and the decreasing tendency. As a result, power supply control can be simplified according to the type of the recording medium.

A fourth invention is based on the image forming apparatus of any one of the first to third inventions, wherein the determination unit performs operation for determining the control target value, at a predetermined time interval that is shorter than a period of time for subjecting one recording medium to transfer operation.

When variations exist in the state of humidity of one recording medium, the load resistance changes according to a location on the recording medium. Therefore, in the present invention, a control target value is controlled at a time interval that is shorter than a period of time for subjecting one recording medium to transfer operation, thereby enabling optimum transfer at each location.

A fifth invention is directed toward the image forming apparatus of the fourth invention, wherein the predetermined time interval is set so as to become shorter than a period of time from when a leading end of the recording medium arrives at a location where the transfer unit opposes the image carrier until when an image generative area of the recording medium arrives at the location.

In normal times, an abrupt change arises in the load resistance value of a circuit system connected to the transfer unit from when the leading end of the recording medium enters a location (a transfer position) where the transfer unit and the image carrier oppose each other. Accordingly, in the present configuration, the time interval is set so as to become shorter than the time from when the leading end of the recording medium arrives at the opposing position until when the leading end arrives at the image generative area, thereby enabling optimum transfer of the image generative area.

According to the present invention, a decrease in image quality, which would otherwise be caused by a change in humidity, can be prevented.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a transfer unit for transferring a toner image carried on an image carrier to a recording medium;

a power supply unit that, while taking a current value imparted to the transfer unit as a control target, supplies power conforming to the control target value to the transfer unit;

a voltage detection unit for detecting a voltage value of the transfer unit;

a current detection unit for detecting a value of a current flowing to the transfer unit; and a determination unit that acquires a detection value of the voltage detection unit and a detection value of the current detection unit and that determines, as a control target value for the power supply unit, an optimum value of a control target derived from a characteristic line showing a relationship between an electric characteristic value based on both detection values and an optimum value of the control target, wherein the characteristic line is a line showing a relationship of a change in absolute value of an optimum value of the control target shifting from an increasing tendency to a decreasing tendency with an increase in an absolute value of the electrical characteristic value.

2. The image forming apparatus according to claim 1, further comprising:

an ascertainment unit for ascertaining a type of the recording medium, wherein the characteristic line has a flat segment, in which the optimum value falls within a predetermined range, between a segment of the increasing tendency and a segment of the decreasing tendency; and the determination unit determines the optimum value by utilization of a characteristic line whose flat segment differs in length according to the type of the recording medium ascertained by the ascertainment unit.

3. The image forming apparatus according to claim 1, further comprising:

an ascertainment unit for ascertaining the type of the recording medium, wherein the determination unit selects, according to the type of the recording medium ascertained by the ascertainment unit, the characteristic line or a monotonous line along which a change in an absolute value of an optimum value of the control target does not reversely increase or decrease with an increase in the electrical characteristic value or an absolute value of a detection value of the voltage detection unit, to thus determine the optimum value.

4. The image forming apparatus according to claim 1, wherein the determination unit performs an operation for determining the control target value, at a predetermined time interval that is shorter than a period of time for subjecting one recording medium to transfer operation.

5. The image forming apparatus according to claim 4, wherein the predetermined time interval is set so as to become shorter than a period of time from when a leading end of the recording medium arrives at a location where the transfer unit opposes the image carrier until when an image generative area of the recording medium arrives at the location.

6. An image forming apparatus comprising:

a transfer unit for transferring a toner image carried on an image carrier to a recording medium;

a power supply unit that, while taking a current value imparted to the transfer unit as a control target, supplies power conforming to the control target value to the transfer unit;

a voltage detection unit for detecting a voltage value of the transfer unit;

a current detection unit for detecting a value of a current flowing to the transfer unit; and a determination unit that acquires a detection value of the voltage detection unit and a detection value of the current detection unit and that determines, as a control target value for the power supply unit, an optimum value of a control target derived from a characteristic line showing a relationship between a detection value of the voltage detection unit and an optimum value of the control target, wherein the characteristic line is a line showing a relationship of a change in absolute value of an optimum value of the control target shifting from an increasing tendency to a decreasing tendency with an increase in an absolute value of the detection value of the voltage detection unit.

* * * * *